US008516719B2

(12) United States Patent
Aveni

(10) Patent No.: US 8,516,719 B2
(45) **Date of Patent: *Aug. 27, 2013**

(54) ARTICLE OF FOOTWEAR CONSTRUCTION WITH BINDING PORTIONS

(75) Inventor: Michael A. Aveni, Lake Oswego, OR (US)

(73) Assignee: NIKE, Inc., Beaverton, OR (US)

( * ) Notice: Subject to any disclaimer, the term of this patent is extended or adjusted under 35 U.S.C. 154(b) by 44 days.

This patent is subject to a terminal disclaimer.

(21) Appl. No.: 13/241,979

(22) Filed: Sep. 23, 2011

(65) Prior Publication Data

US 2012/0011741 A1 Jan. 19, 2012

Related U.S. Application Data

(63) Continuation of application No. 12/104,179, filed on Apr. 16, 2008, now Pat. No. 8,051,581.

(60) Provisional application No. 60/912,600, filed on Apr. 18, 2007.

(51) Int. Cl.
*A43B 13/28* (2006.01)
*A43B 3/14* (2006.01)

(52) U.S. Cl.
USPC ..... 36/12; 36/11; 36/15; 12/142 T

(58) Field of Classification Search
USPC ..... 36/12, 15, 11, 18, 21, 11.5; 12/146 BC, 12/146 BP, 142 T, 142 C, 142 RS
See application file for complete search history.

(56) References Cited

U.S. PATENT DOCUMENTS

| | | | | |
|---|---|---|---|---|
| 1,841,058 | A * | 1/1932 | Rosenwasser | 36/16 |
| 1,871,763 | A * | 8/1932 | Wiggin | 36/11 |
| 2,364,373 | A * | 12/1944 | Kleven | 36/12 |
| 2,407,556 | A | 9/1946 | Kleven | |
| 2,417,776 | A | 3/1947 | Nuenuebel | |
| 2,438,711 | A | 3/1948 | Leach | |

(Continued)

FOREIGN PATENT DOCUMENTS

| | | |
|---|---|---|
| FR | 1033069 | 7/1953 |
| FR | 1171747 | 1/1959 |
| JP | 2002306201 | 10/2002 |

OTHER PUBLICATIONS

International Search Report for PCT/US2008/059660 mailed Jun. 30, 2008.

*Primary Examiner* — Marie Patterson
(74) *Attorney, Agent, or Firm* — Banner & Witcoff, Ltd.

(57) ABSTRACT

At least one invention pertains to an article of footwear having a foot-receiving portion and a sole portion attached via at least one binding element. In one aspect, an article of footwear includes a foot-receiving portion configured to extend over a portion of a foot of a wearer, and the foot-receiving portion being configured to extend to medial and lateral side of the foot, and the foot-receiving portion including a binding element. A sole portion having a top surface for contacting the foot and a lower surface for a least a portion provided ground engagement. A plurality of apertures extending through the top surface and lower surface, the apertures are configured to receive the binding element therein to attach the foot-receiving portion to the sole portion.

15 Claims, 7 Drawing Sheets

(56) References Cited

U.S. PATENT DOCUMENTS

| | | | | |
|---|---|---|---|---|
| 2,551,723 | A | 5/1951 | Camero | |
| 2,724,913 | A | 11/1955 | Russell | |
| 4,308,671 | A | 1/1982 | Bretschneider | |
| 4,551,929 | A | 11/1985 | Paris | |
| 5,146,697 | A | 9/1992 | Weiss | |
| 6,904,705 | B2 | 6/2005 | Polegato | |
| 6,966,128 | B2 | 11/2005 | McClaskie | |
| 6,976,320 | B2 | 12/2005 | McClaskie | |
| 8,051,581 | B2 * | 11/2011 | Aveni | 36/12 |
| 2006/0130360 | A1 * | 6/2006 | Issler | 36/16 |

* cited by examiner 77
70
46
45
30

76
46
45
77
30

46
45
30
77

72
46
45
30
77

77
72
72
30

ARTICLE OF FOOTWEAR CONSTRUCTION WITH BINDING PORTIONS

CROSS REFERENCE TO RELATED APPLICATIONS

The present application is a continuation application which claims benefit of U.S. application Ser. No. 12/104/179 filed Apr. 16, 2008, now U.S. Pat. No. 8,051,581 which claims priority to provisional application No. 60/912,600, filed Apr. 18, 2007 the entire contents is incorporated by reference herein.

FIELD OF THE INVENTION

The present invention relates to footwear, more particularly to, an article of footwear having a sole portion and upper portion using binding portions.

BACKGROUND

The various styles of conventional footwear include athletic footwear, sandals, dress shoes, and boots, for example, and are generally formed of two primary elements, an upper and a sole structure. The specific configuration of the upper and sole structure varies significantly depending upon the style of footwear and the intended use for the footwear. Although conventional articles of footwear vary greatly with respect to the configuration of the upper and the sole structure, a common feature of most conventional articles of footwear is that the sole structure is permanently attached to each other via cements or adhesives.

SUMMARY OF THE INVENTION

The invention pertains to an article of footwear having a foot-receiving portion and a sole portion attached via at least one binding element.

In one aspect, an article of footwear includes a foot-receiving portion configured to extend over a portion of a foot of a wearer, and the foot-receiving portion is configured to extend to medial and lateral side of the foot. The foot-receiving portion including a binding element. A sole portion has a top surface for contacting the foot and a lower surface in which a least a portion provides ground engagement. A plurality of apertures extending through the top surface and lower surface, the apertures are configured to receive the binding element therein to attach the foot-receiving portion to the sole portion.

In another arrangement, the article of footwear may include the sole portion having a midsole and an outsole in which the apertures extend through the midsole and outsole. In yet another aspect, the sole portion includes a perimeter channel for receiving a portion of the binding element. In another aspect, the sole portion includes a side channel for receiving a portion of the binding element.

In an alternative arrangement, the sole portion includes a bottom channel for receiving a portion of the binding element. In yet another configuration, the sole portion includes a midsole; and an outsole and the apertures extends through the midsole and outsole and at least one channel is disposed in the outsole for receiving a portion of the binding element. In another arrangement, at least one aperture is disposed adjacent to least one channel of the sole portion.

DESCRIPTION OF THE DRAWINGS

The foregoing Summary of the Invention, as well as the following Detailed Description of the Invention, will be better understood when read in conjunction with the accompanying drawings.

DETAILED DESCRIPTION

Figure 1:
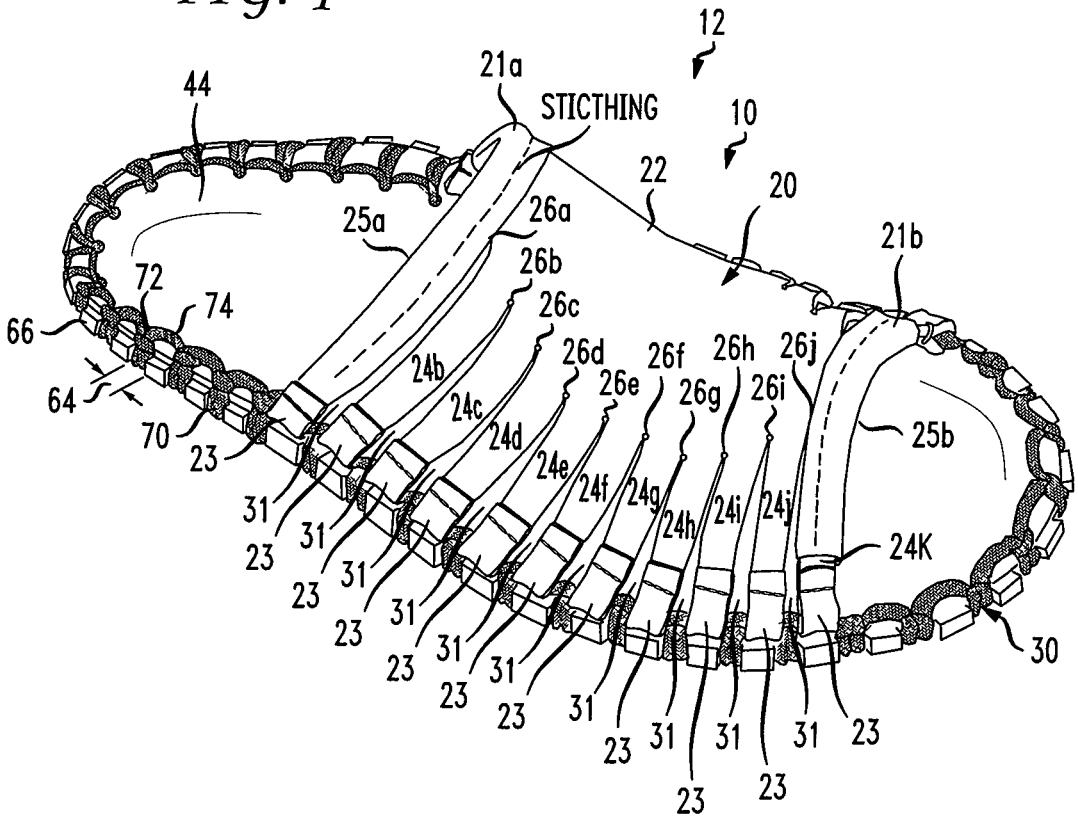
FIG. 1 is a schematic perspective view of an embodiment of an article of footwear.

In the following description of the various embodiments, reference is made to the accompanying drawings that depict illustrative arrangements in which the invention may be practiced. It is understood that other embodiments may be utilized and modifications may be made without departing from the scope of the present invention. Additionally, various terms used herein are defined below.

The figures and following discussion disclose an article of footwear 10 in accordance with the present invention. Footwear 10 is depicted in FIGS. 1-7 and includes two primary elements: a foot-receiving portion 20 and a sole portion 30. The upper and sole structures of most conventional articles of footwear are permanently attached to each other by chemical materials, such as adhesive and cement. Unlike conventional articles of footwear, however, the article of footwear 10 provides an environmentally efficient design that eliminates the need for cements or adhesives when fastening an outsole, midsole, sockliner or upper together. A binding element, such as a cord, is threaded through corresponding apertures in the sockliner 40, midsole 50, and outsole 60 to positively lock the footwear elements together via a snug or friction-fit arrangement. Generally, disposed at each aperture, a knot is provided to maintain generally uniform tension on the cord and eliminate potentially unwinding of the entire cord so as to reliably secure the article of footwear 10.

Footwear 10 is depicted in the figures as having the configuration of a sandal. The concepts relating to footwear 10, which are presented in the following discussion, may be applied to a wide range of other footwear styles that include athletic footwear, dress shoes, and causal shoes, for example. One skilled in the relevant art will recognize, therefore, that the concepts disclosed in the following discussion with respect to footwear 10 are not intended to be limited solely to footwear having the general configuration of a sandal, and may be applied to a wide range of other footwear styles.

Foot-receiving portion 20 can be construction of a desirable material or a combination of materials such as, split-leather, full-grain leather, synthetic leather, or other desirable material for a three-dimensional configuration. For ease of explanation, footwear 10 has a medial side 12 and a lateral side 14. When the footwear 10 is worn, the lateral side generally faces away from the center line of a user's body. Likewise, the medial side 16 generally faces inward towards the centerline of a user's body. The terms forefoot region, midfoot region, and rearfoot region as used herein generally correspond to the locations of the forefoot, midfoot, and rearfoot of a wearer as would be understood by one of ordinary skill in the art. For ease of explanation, a heel-to-toe axis A-A is generally defined herein as the direction when a wearer of footwear 10 is moving in a forward motion (See FIG. 1). This heel-to-toe axis A-A generally bisects through the center of the footwear 10 for designating medial and lateral halves or sides.

Figure 2:
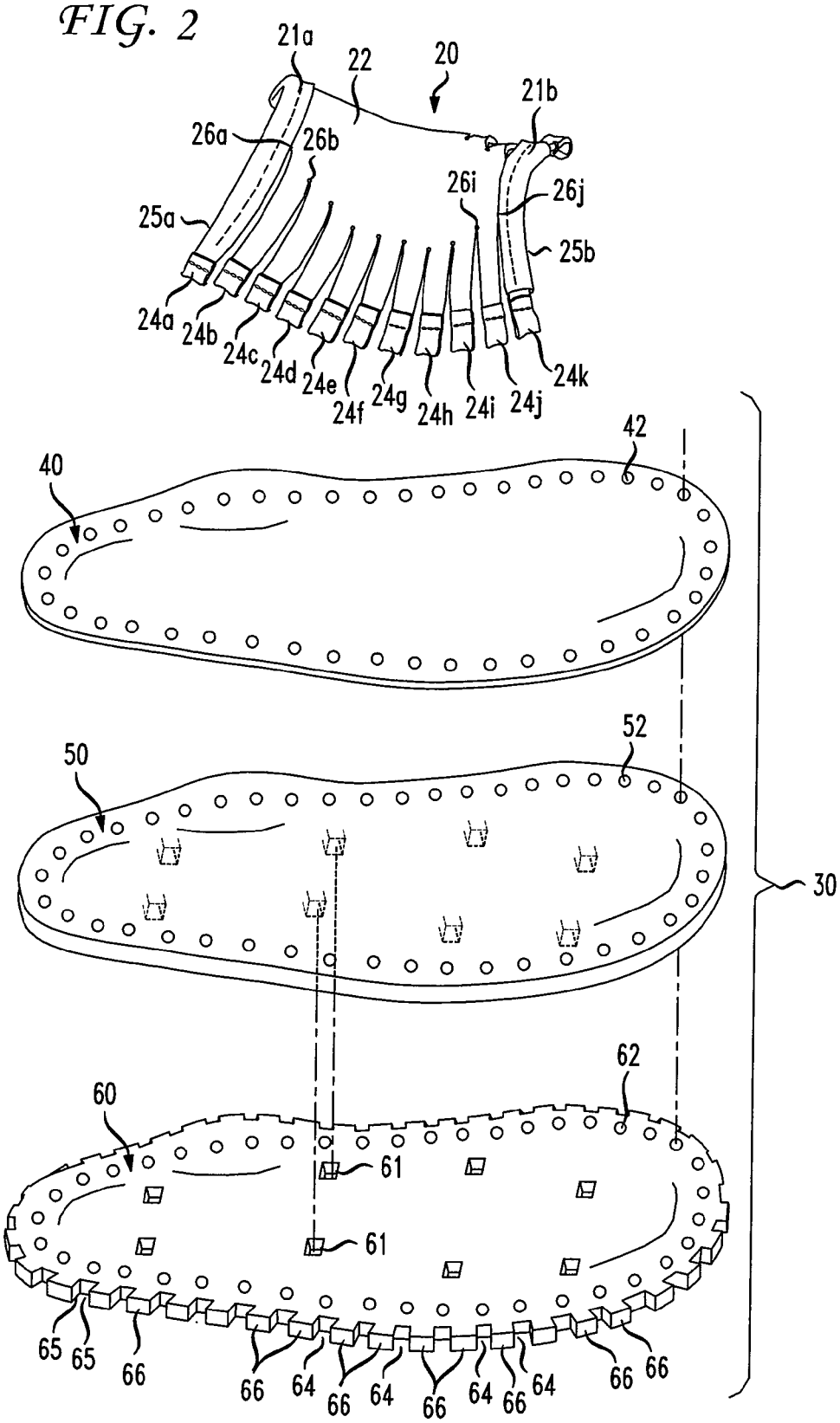
FIG. 2 is a schematic exposed assembly view of the article of footwear of FIG. 1.
Figure 7:
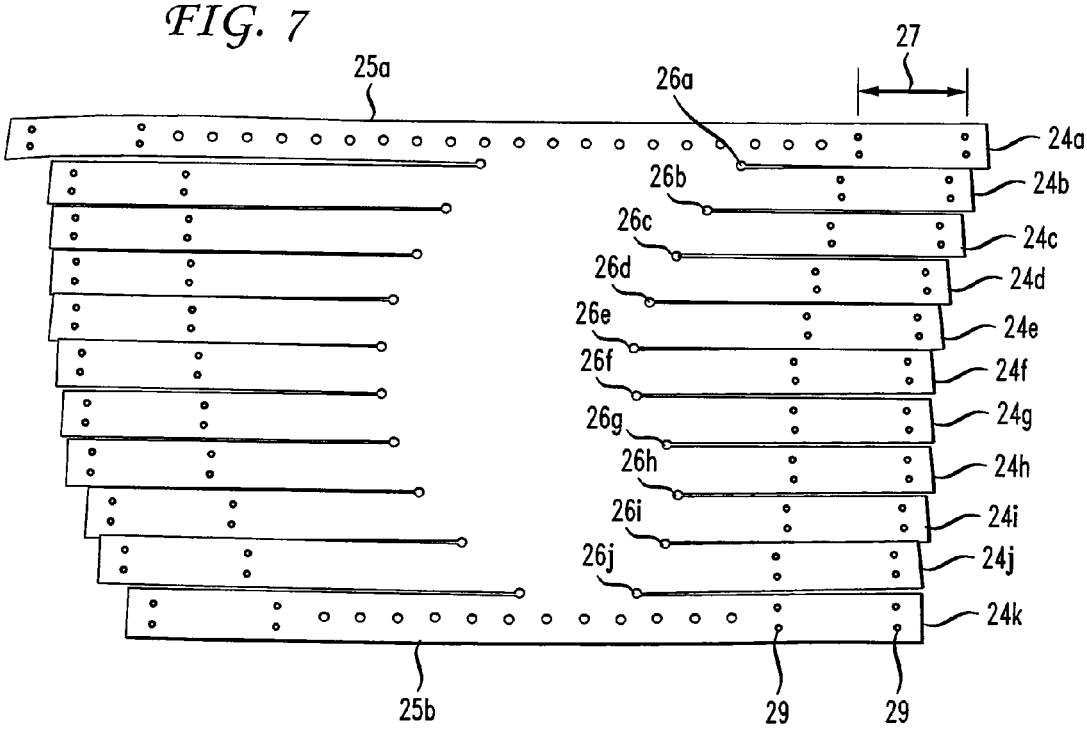
FIG. 7 is a top view of a flat configuration of the upper blank with portions to form a three dimensional upper of the article of footwear of FIG. 1.

The foot-receiving portion 20, as depicted in FIGS. 1, 2 and 7, includes bumper elements 21*a*-21*b* and a covering body 22 integrally formed with extending finger elements 24*a*-24*k*. (See FIG. 7) In general, the purpose of foot-receiving portion 20 is to comfortably and securely receive a foot of a wearer. The covering body 22 can have a material thickness 2.0 mm or greater for shape retaining properties. Nevertheless, other values are possible. As depicted in the figures, covering body 22 extends over the midfoot and a portion of the forefoot so as to leave the toes, heel, and a portion of the forefoot exposed. As will be described in greater detail below, covering body 22 may have a variety of footwear styles, including sandal-type configurations. In addition, covering body 22 may be manufactured in the configuration of a shoe to cover the entire foot. If, however, footwear 10 is manufactured in the style of a boot, covering body 22 may be extended upwards to cover the ankle and a portion of the leg. One skilled in the relevant art will appreciate, therefore, that the specific configuration of covering body 22 may vary greatly within the scope of the present invention.

Referring to FIG. 7, the covering body 22 is provided with extending fingers elements 24*a*-24*k* disposed on the medial and lateral side. Finger elements 24*a*-24*k* includes prepunched stitching holes 29 for overlapping the distal portions 27 of the fingers for forming attachment loop portions 23 to secure the foot-receiving portion 20 to the sole portion 30 by way of binding element 70 (see FIG. 1). In another configuration, holes 29 may not be used in an automated manufacturing operation. Hence, the holes 29 are not necessary for use with the article of footwear.

A folding contour line is defined by the in-line sequence of apertures 26*a*-26*j*. Apertures 26*a*-26*j* are generally provided in a direction of the axis A-A or heel-to-toe axis. In one construction, the foot-receiving portion 20 includes apertures 26*a*-26*j* defining a fold line adjacent to a proximal end of the fingers 24*a*-24*k*. Covering body 22 includes a medial folding contour line and a lateral folding contour line. As shown FIG. 7, the folding contour lines are in an arcuate arrangement to provide a comfortable secure fit to the foot of a wearer. Nevertheless, the folding contour lines can be various shapes. In one example, the folding contour lines may be generally parallel with the heel-to-toe axis. In one construction, a folding contour line may be a thin band of a weaken region of material. The thin band can be a specific area on the covering body 22 formed by perforations, for example. Nevertheless, the fold line may be simply a predetermined area for folding or bending along a part of the covering body without a weaken area.

Foot-receiving portion 20 is secured to the sole portion 30 using binding element 70, such as cord, via friction fit arrangement. While a cord or lashing cord is discussed herein, the cord can be multiple filament rope or formed of a webbing material. The cord can be round-shaped, flat or other shape. In one construction, a knot lashing arrangement is provided by connecting the footwear 10 together (outsole 60, midsole 50, sockliner 40, and foot-receiving portion 20) without the use of cement or adhesives. To form the three-dimension arrangement of the foot-receiving portion 20, the covering body 22 is bent along the folding contour lines and finger elements 24*a*-24*k* are attached to the sole portion 30 by the binding element 70. This action causes the finger elements 24*a*-24*k* to separate or spread apart from each other to form triangular separation portions 31. The triangular separation portions 31 formed between the finger elements 24*a*-24*k* create air gaps to allow air to flow into the interior of the foot-receiving portion 20 from the medial side 12 and lateral side 14. This configuration helps ventilate the foot of a wearer.

Bumper elements 21*a*-21*b* are provided at the instep edge 25*a* and toe edge 25*b* of the foot receiving portion 20. The bumper elements 21*a*-21*b* are sewn or otherwise attached on the edges 25*a* and 25*b* by conventional methods. In one construction, the bumper elements 21*a*-*b* creates a structural feature to provide a degree of rigidity to the covering body 22 which gives the foot-receiving portion 20 a curved shape. This arrangement provides an instep opening and toe opening for the foot to easily and comfortably slide into the foot-receiving portion 20. The bumper elements 21*a*-21*b*, further limits the stretch medial to lateral of the cover body 22 in a leather material arrangement.

Sole portion 30, depicted individually in FIG. 2, generally serves the function of a sole structure for an article of footwear 10. Sole portion 30 attenuates ground reaction forces and absorbs energy as the footwear 10 contacts the ground, and may incorporate multiple layers that are referred to as a the sockliner 30, midsole 50 and an outsole 60. The midsole 50 forms the middle layer of the sole. The outsole 60 forms the ground-contacting element of footwear 10 and may be fashioned from a durable, wear resistant material that includes texturing to improve fraction. The midsole 50 provides cushioning and support and is more compressible than outsole 60 to achieve its cushioning function. The midsole 50 may be composed of resilient foam material, such as polyurethane (PU) open cell, PU closed cell, or a similar material. The midsole includes a bottom surface with protrusions 54 configured to be ground-engaging portions in combination with the outsole.

Figure 3:
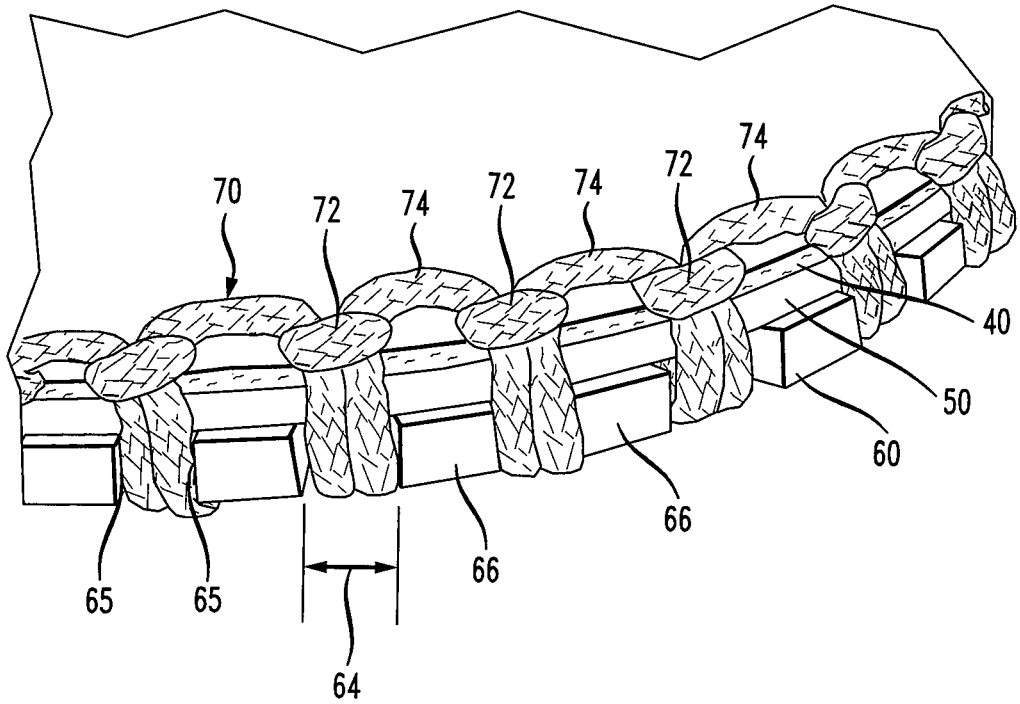
FIG. 3 is an enlarged schematic side view of a portion of the article of footwear of FIG. 1.
Figure 4:
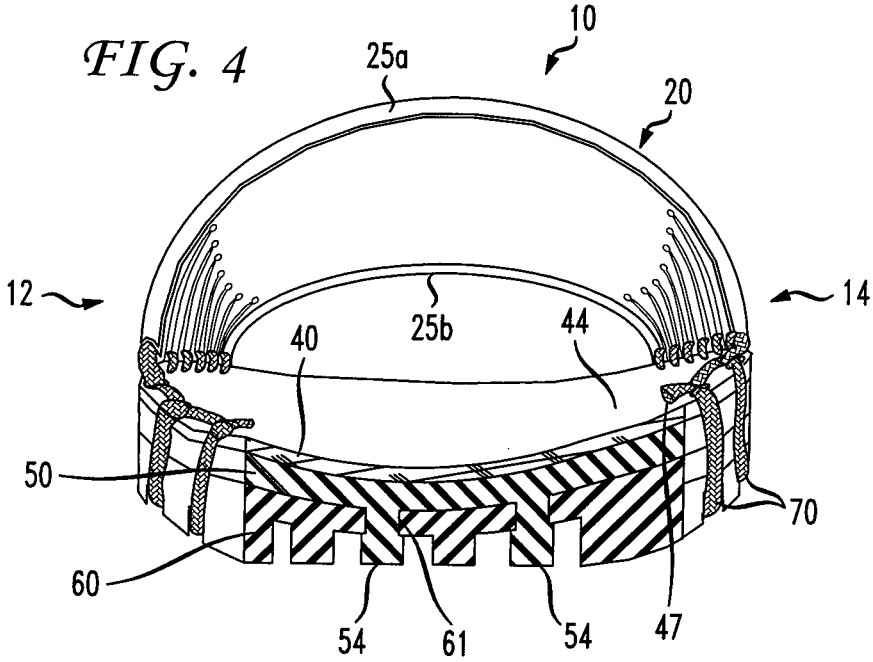
FIG. 4 is a schematic section view of a portion of the article of footwear of FIG. 1 in a heel region.
Figure 5:
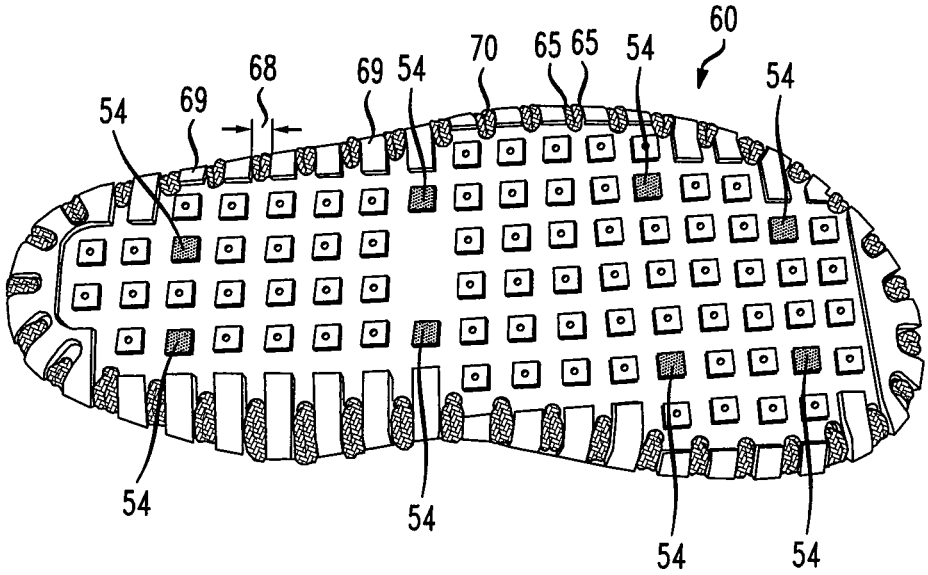
FIG. 5 is a schematic bottom view of the outsole part of the article of footwear of FIG. 1.

Binding element, such as a cord lashing 70, is threaded through corresponding apertures 42, 52, 62 in the sockliner 40, midsole 50, and outsole 60 to positively lock the footwear elements together via a snug or friction-fit arrangement. As shown in FIGS. 1-3, side perimeter channels 64 are provided at the vertical side perimeter of the outsole 60. The channels 64 are formed between adjacent perimeter protrusions 66 of the outsole 60. Referring to FIG. 5, bottom channels 68 are formed between adjacent thread portions 69 of the outsole 60. The cord lashing 70 is received within the interior of channel 64 and of channel 68 to hold the sole portion 30 together. The use of the channel 64 and channel 68 protects the cord lashing 70 from damage when the footwear 10 is worn. On the side perimeter of outsole 60, the cord lashing 70 is protected from side impacts and debris. On the bottom of the outsole 60, the cord lashing 70 is protected from ground contact damage. Further, the cord lashing 70 places a compressive force along the perimeter of the sockliner 40, midsole 50, and outsole 60. It noted that the opposing sidewalls 65 of the channels 64 and channel 68 are disposed generally transverse to the heel-to-toe axis A-A. This sidewall arrangement prevents longitudinal movement of the cord lashing 70 during the foot movement and maintains the general uniform tension on the cord lashing 70 to prevent unwinding.

In addition, the sockliner 40 further includes an upper surface defining a footbed 44, that is the portion of the footwear 10 that is in contact with the bottom of the foot of the wearer. A footbed or cradle is created by the binding element, (e.g., cord lashing 70) disposed along the perimeter of the sole portion 30. This arrangement allows the foot to self-center in the footwear 10. Additionally, the binding element arrangement may act as a bumper to prevent the foot from slipping of the footbed. Further, the top surface of the sole portion 30 includes a perimeter cupped portion 47 having the apertures and binding elements therein to define a foot centering arrangement. (See FIG. 4)

Figures 6A, 6B, 6C, 6D, 6E:
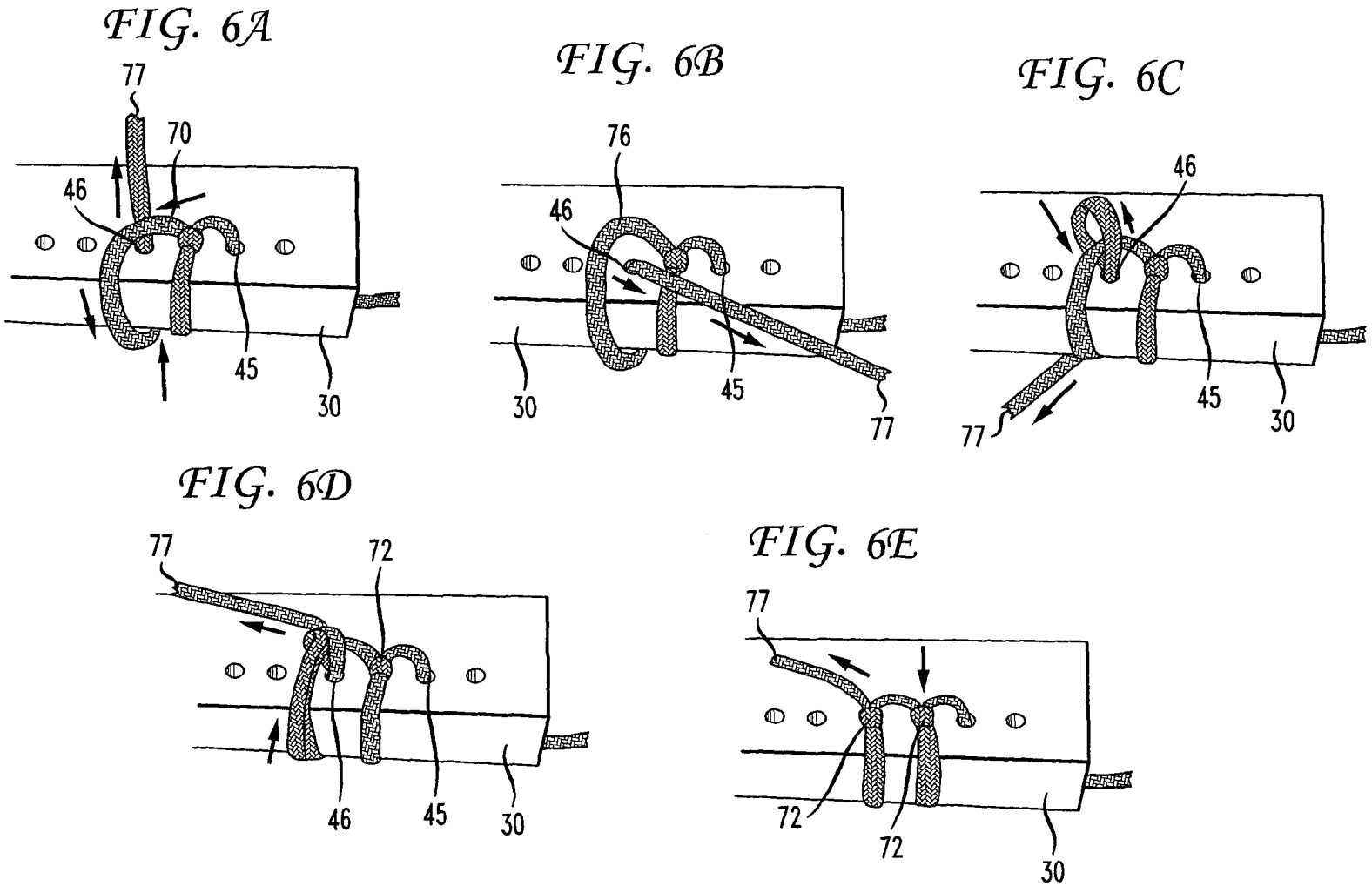
FIGS. 6A-E are schematic views of a looping construction for the article of footwear of FIG. 1.

FIGS. 6A-6E are views of a loop construction for forming the article of footwear. With reference to FIG. 6A, at least one knot and is formed on the sole portion 30. To make the next connection, start by threading from bottom to top, the end 77 of the cord lashing 70 through the next hole 46 in the sole portion 30. Referring to FIG. 6B, loop the cord 70 through the loop portion 76 created in the preceding step in FIG. 6A. In FIG. 6C, loop the cord 70 back into the previous hole 46. With reference to FIG. 6D, the end 77 of cord 70 in threaded into the loop created in FIG. 6C. In FIG. 6E, the distal end 77 of the cord 70 is pulled to tighten and form the knot 72. A bridge 74 is created between each knot 72 is where the upper loop is captured. To construct the footwear 10, the midsole 50 waffle protrusions 54 are snapped into receiving windows 61 of the outsole 60. (See FIGS. 2 and 4). The loops 23 of the foot-receiving portion 20 receive the bridges of the cord lashing 70 to secure the foot-receiving portion 20 to the sole portion 30.

It is noted that the features of the article of footwear 10 individually and/or in any combination, improve manufacturing efficiency, structural integrity and other benefits, including environmental reuse. Regarding the environmental aspects, after the useful life of the footwear 10, footwear 10 can easy disassembled for separation and reuse of materials. Further, the cover body 22 provides efficient material usage by enabling fingers to extend in the directions of the heel-to-toe axis A-A.

Figure 8:
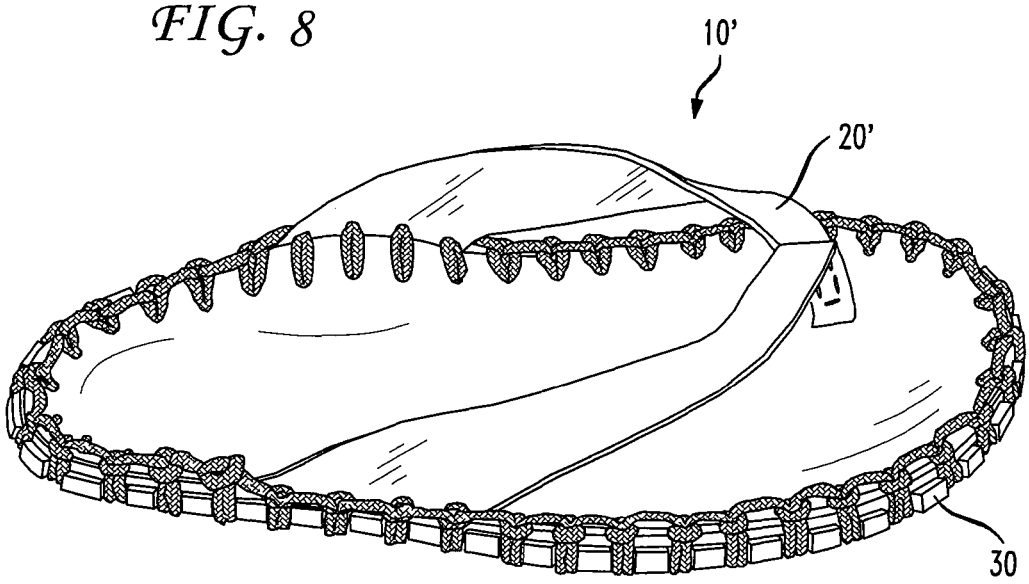
FIG. 8 is a perspective view of an alternative embodiment of an article of footwear with an outsole, midsole, and footbed construction as the embodiment of FIG. 1.

While the various features of shoe 10 work together to achieve the advantages previously described, it is recognized that individual features and sub-combinations of these features can be used to obtain some of the aforementioned advantages without the necessity to adopt all of these features. For example, in FIG. 8, the article of footwear 10' may have an alternative foot-receiving portion 20'. Nevertheless, the sole portion 30 is the same as the embodiment of FIG. 1. The cord lashing 70 is similar to the embodiment of FIG. 1 for connecting the foot-receiving portion 20' to the sole portion 30. Another foot-receiving portion may also be utilized that covers a substantial portion of the foot and, therefore, has the configuration of an upper for a running shoe, for example. Nevertheless, other arrangements are possible.

The present invention is disclosed above and in the accompanying drawings with reference to a variety of embodiments. The purpose served by disclosure of the embodiments, however, is to provide an example of the various aspects embodied in the invention, not to limit the scope of the invention. One skilled in the art will recognize that numerous variations and modifications may be made to the embodiments without departing from the scope of the present invention, as defined by the appended claims.

The invention claimed is:

1. An article of footwear comprising:

a foot-receiving portion configured to extend over a portion of a foot of a wearer, and the foot-receiving portion being configured to extend to medial and lateral side of the foot, and the foot-receiving portion including a binding element; and a sole portion having a top surface for contacting the foot and a lower surface for provided for ground engagement, a midsole, a plurality of apertures extending through the top surface and the lower surface, the apertures being configured to receive the binding element therein to attach the foot-receiving portion to the sole portion; wherein the foot-receiving portion in an unassembled state is generally flat and, the foot-receiving portion in an assembled configuration retains a three-dimensional shape; the sole portion including a channel for retaining the binding element; wherein the foot-receiving portion includes a plurality of fingers extending to one of the medial side and lateral side.

2. The article of footwear according to claim 1, wherein the sole portion includes an outsole, the apertures extending through the midsole and the outsole.

3. The article of footwear according to claim 1, wherein the channel comprises a perimeter channel for retaining a vertical portion of the binding element.

4. The article of footwear according to claim 1, wherein the channel comprises a side channel for receiving a vertical portion of the binding element.

5. The article of footwear according to claim 1, wherein the channel comprises a bottom channel for receiving a horizontal portion of the binding element.

6. The article of footwear according to claim 1, wherein the sole portion includes a sockliner, midsole and an outsole, the apertures extending through the sockliner, midsole and outsole, a plurality of channels are disposed in the outsole for receiving vertical portions of the binding element.

7. The article of footwear according to claim 6, wherein the plurality of apertures are disposed corresponding to adjacent channels.

8. The article of footwear according to claim 6, wherein the midsole includes a bottom surface with protrusions configured to be ground-engaging portions in combination with the outsole.

9. The article of footwear according to claim 8, wherein the outsole includes windows for receiving the protrusions of the midsole.

10. The article of footwear according to claim 1, wherein the binding element includes a plurality of knots above the sole portion with a bridge extending between adjacent knots.

11. The article of footwear according to claim 1, wherein at least one finger includes a loop portion which receives a portion of the binding element.

12. The article of footwear according to claim 11, wherein the binding element includes a plurality of knots having a bridge extending between adjacent knots and the bridge receives the loop portion of the at least one finger.

13. The article of footwear according to claim 1, wherein the air gaps are provided between adjacent fingers.

14. The article of footwear according to claim 1, wherein the foot-receiving portion includes apertures defining a fold line adjacent to a proximal end of the fingers.

15. The article of footwear according to claim 1, wherein the top surface of the sole portion includes a perimeter cupped portion having the apertures and binding elements therein to define a foot centering arrangement.

* * * * *